United States Patent [19]

Rogers et al.

[11] Patent Number: 4,470,273

[45] Date of Patent: Sep. 11, 1984

[54] ROW COUNTER

[75] Inventors: Wilfred D. Rogers, Solihull; Richard G. Budd, Birmingham, both of England

[73] Assignee: Needle Industries Limited, Studley, England

[21] Appl. No.: 376,016

[22] Filed: May 7, 1982

[51] Int. Cl.[3] ..... D04B 3/00; D04B 3/02

[52] U.S. Cl. ..... 66/1 A; 66/117; 116/312; 116/315

[58] Field of Search ..... 66/1 A, 117, 118; 116/307, 312, 315, DIG. 21

[56] References Cited

U.S. PATENT DOCUMENTS

| | | | |
|---|---|---|---|
| 2,821,953 | 2/1958 | Langbart et al. | 116/312 |
| 2,887,858 | 5/1959 | Sanders | 66/117 |
| 2,918,035 | 12/1959 | Sanders | 66/117 X |
| 3,777,699 | 12/1973 | Pfleger | 116/315 X |

FOREIGN PATENT DOCUMENTS

| | | | |
|---|---|---|---|
| 137780 | 9/1948 | Australia | 66/1 A |
| 424432 | 2/1935 | United Kingdom | 66/117 |
| 678597 | 9/1952 | United Kingdom | 66/117 |
| 867504 | 5/1961 | United Kingdom | 66/117 |
| 867505 | 5/1961 | United Kingdom | 66/117 |
| 245185 | 11/1969 | U.S.S.R. | 116/315 |

*Primary Examiner*—Wm. Carter Reynolds
*Attorney, Agent, or Firm*—Klarquist, Sparkman, Campbell, Leigh & Whinston

[57] ABSTRACT

In a knitting row counter, a settable member has a projection which can engage in a selected one of a number of recesses in a further member but is expelled from the recess on rotation of the settable member. A finger on the settable member engages in a groove in the further member to retain the members in assembled relation. The settable member flexes resiliently to permit the projection to be withdrawn from the recess.

1 Claim, 4 Drawing Figures

FIG 1
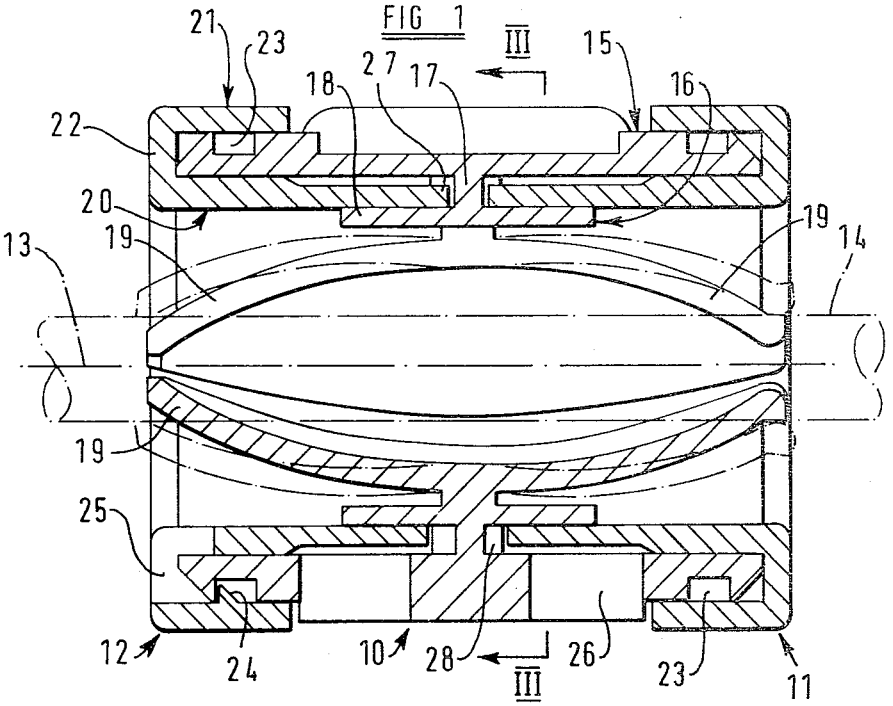
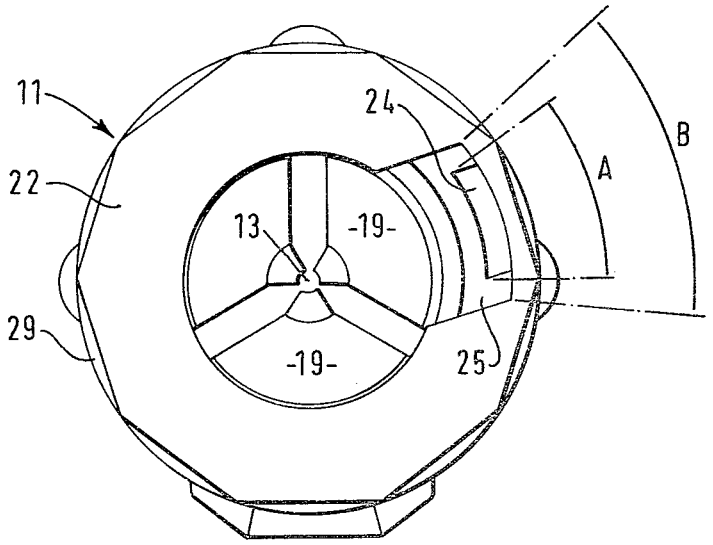
FIG 2

FIG 3
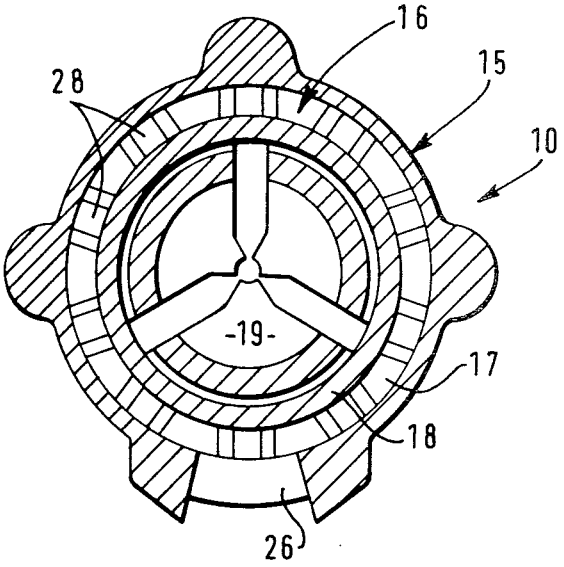
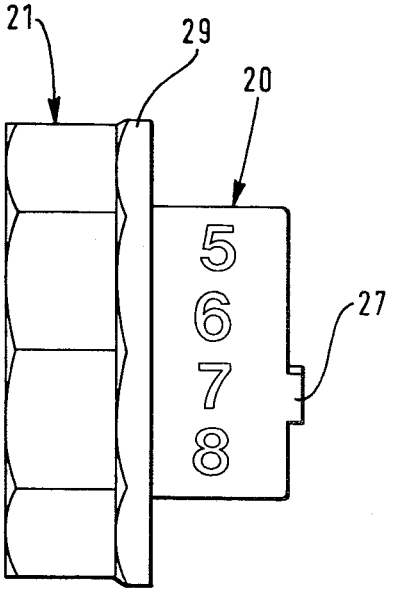
FIG 4

ROW COUNTER

BACKGROUND OF THE INVENTION

This invention relates to a row counter of the kind, hereinafter called the kind specified, comprising a body member and a settable member, one of which members bears a series of numerals or other characters and which settable member can be set in different positions relative to the body member to indicate or display to a user respective ones of the characters and the body member being adapted to be mounted on a knitting needle.

SUMMARY OF THE INVENTION

According to the invention there is provided a counter of the kind specified comprising indexing means for defining alternative positions of the settable member relative to the body member and for yieldably constraining the settable member against movement relative to the body from any one of said alternative positions into which it has been set.

The indexing means reduces the risk of the settable member being moved inadvertently relative to the body member. The number of alternative positions would be selected in accordance with the number of alternative characters to be displayed or indicated and the indexing means then reduces the risk of an ambiguous indication or display being presented.

In the preferred construction, at least one of the members is of generally tubular form and the indexing means comprises a row of recesses in a first of the members and at least one projection on a second of the members, the projection being engageable in a selected one of the recesses and the recesses and projection lie at the inside of said one member. With this arrangement, the recesses are shielded by the one member against accumulation of foreign matter in the recesses and the projection also is shielded by the one member against entanglement with fibrous matter.

BRIEF DESCRIPTION OF THE DRAWINGS

An example of a knitting row counter embodying the invention will now be described, with reference to the accompanying drawings, wherein:

FIG. 1 shows a cross-section of the counter in a plane containing an axis of the counter;

FIG. 2 shows an end view of the counter;

FIG. 3 shows a cross-section of a body only of the counter along the line III—III of FIG. 1; and FIG. 4 shows a side view of a settable member only of the counter.

DETAILED DESCRIPTION

The counter comprises a body member 10 which is adapted to be fitted on a knitting needle and two settable members 11 and 12, mounted on the body member for rotation relative thereto independently about an axis 13 of the counter which coincides with a longitudinal axis of the needle indicated at 14 by a chain line in FIG. 1.

The body member 10 is of generally tubular form and comprises an outer, generally cylindrical wall 15, an inner part 16 and a web 17 extending from the outer wall to the inner part at a position mid-way between opposite ends of the body member. The inner part 16 includes an annular portion 18 which is spaced radially inwardly from and is co-axial with the outer wall 15. From the radially inwardly facing surface of the annular portion 18, there project in opposite axial directions gripping elements 19 for gripping the needle, as indicated in chain lines in FIG. 1. The gripping elements collectively have a barrel-like shape and in the particular example illustrated, there are six gripping elements, three having free ends adjacent to one end of the counter and the other three having free ends adjacent to the opposite end of the counter. The gripping elements are sufficiently resiliently flexible to receive and grip securely needles having a variety of different diameters.

Each of the settable members 11 and 12 comprises an inner tubular part 20, an outer, co-axial tubular part 21 and an end wall 22 extending between the inner and outer parts. The inner parts 20 each lie at the inside of the outer wall 15 of the body member and are disposed between that outer wall and the annular portion 18.

Each of the settable members 11 and 12 is a snap-fit on the body member 10. In the radially outwardly facing surface of the outer wall 15 of the body member, there is formed adjacent to each end of the body member an annular groove 23, the open mouth of which faces radially outwardly. There projects radially inwardly from each of the outer portions 21 a finger 24 which engages in the corresponding groove 23. The fingers 24 each subtend at the axis 13 an angle A which is typically 36°.

There is formed in each settable member 11 and 12 adjacent to its finger 24 an aperture 25 which extends axially inwardly from an exposed end of the settable member through the end wall 22 into the inner part 20. Adjacent to the outer part 21, this aperture subtends at the axis 13 an angle B which exceeds the angle A but is less than twice the angle A. The angle B also contains the angle A, by which we mean that the sector occupied by the aperture 25, as viewed along the axis 13, contains the sector occupied by the finger 24. The centre of the finger and the centre of the aperture lie in the same plane containing the axis 13.

The settable members 11 and 12 are formed of a resiliently flexible material, for example polystyrene, so that limited relative axial displacement of the finger 24 and inner part 20 of each settable member can occur by flexing of the member.

It will be seen from FIG. 1 that each of the grooves 23 is substantially sealed against ingress of foreign matter, the outer wall 15 being in sliding contact with both of the inner parts 20 and with the both of the outer parts 21 at respective positions lying axially inwardly of the grooves 23. The free ends of the outer wall 15 are chamfered to facilitate entry into the annular space between the inner part 20 and outer part 21 of each settable member. During assembly of the body member and settable members, the fingers 24 are flexed radially outwardly relative to the inner parts 20.

At positions spaced from the outer parts 21 of the settable members, there are formed in the outer wall 15 of the body member two windows 26, through respective ones of which the outwardly facing surfaces of the inner parts 20 of the settable members can be viewed. On these surfaces are marked or embossed a series of characters, for example the numbers 0 to 9. Only one entire character can be viewed through each window at any one time. Indexing means is provided for defining alternative positions of the settable members, in each of which positions a respective character can be viewed through one of the windows 26. Indexing means of identical form are provided for the settable members 11 and 12 and accordingly the indexing means for the member 11 only will be described.

In the surface of the web 17 facing axially towards the settable member 11, there is formed a series of recesses 28 which are spaced apart around the axis 13. There projects in the axial direction from the axially inner end of the inner portion 20 of the member 11 a finger 27 which can seat in any selected one of the recesses 28. As viewed in a direction towards the axis, the finger may have a rounded profile so that when torque is applied to the settable member to turn the settable member about the axis 13 relative to the body member 10, the finger 27 will be expelled from a recess 28, causing slight axial displacement of the inner portion 20, and the finger will snap into the next recess 28 if the settable member is turned sufficiently. Opposite sides of each recess 28 may be mutually inclined to facilitate the camming action of the finger 27 on the sides. The recesses 28 define alternative positions for the finger 27, in each of which a corresponding number is displayed through one of the windows 26. The indexing means yieldably constrains the settable member 11 against movement relative to the body member 10 from any one of these alternative positions into which it has been set by a user.

The inner parts 20 of the settable members 11 and 12 engage in sliding contact with the annular portion 18 so that the recesses 28 are sealed against ingress of foreign matter. Furthermore, the finger 27 is protected by the annular portion 18 and the outer wall 15 from entanglement with fibrous material.

It will be appreciated that the indexing means may alternatively comprise a row of recesses in the axially inner end of each inner portion 20 and co-operating projections on the web 17.

As shown in the drawing, the indexing means for each settable member is adjacent to one end of that member; whereas the finger 24 of that member is adjacent to an opposite end of the member, being provided on an outer end portion of the member.

To facilitate turning of the settable members 11 and 12 relative to the body member 10, these members are formed with non-cylindrical external profiles. In the example illustrated, the settable members have hexagonal profiles and the body member 10 has a number of protruberances on the outer wall 15. The settable members also have respective flanges 29 which project slightly radially outwardly from the hexagonal profiles. These flanges facilitate gripping of a settable member by a user in a manner such that the settable member can be withdrawn slightly from the body member 10 in a direction away from the other settable member and then rotated to display a fresh number in the corresponding window 26. When the settable member is released, the finger 27 of the settable member moves into a corresponding recess 28 as the stress applied to the settable member by a user is relieved or partly relieved.

Whilst we prefer to mark on each settable member a row of numerals, one of which numerals can be exposed in the corresponding window 26 whilst the remaining numerals are concealed by the body member, it will be appreciated that the numerals could be marked or embossed on the outer parts 21 of the settable members so that the entire row is exposed to view. In this case, a datum mark or formation would be provided on the body member to indicate a particular one of the row of numerals. Alternatively, the row of numerals could be provided on the body member and the datum mark or formation provided on the settable member.

We claim:

1. In a row counter comprising a body member and a settable member, one of which members bears a series of numerals or other characters and which settable member can be set in different positions relative to the body member to indicate or display to a user respective ones of the characters, the body member being adapted to be mounted on a knitting needle, the improvement wherein said members are provided with indexing means for defining alternative positions of the settable member relative to the body member and for yieldably constraining the settable member against movement relative to the body member from any one of said alternative positions into which it has been set, wherein the body member comprises an outer wall and an inner part spaced radially inwardly from the outer wall and including gripping elements for engaging a needle when the needle extends through the counter, and wherein the body further comprises a web extending from the outer wall to the inner part, wherein the settable member comprises an inner tubular part which lies at the inside of the outer wall of the body member and an outer part which is accessible at the outside of the counter, wherein an annular recess is formed in the outer wall of the body member and the outer part of the settable member has a projection which engages in the recess to retain said members in assembled relation with each other and wherein the outer part of the settable member is of generally tubular form and is co-axial with the inner part thereof, there is in the settable member an aperture which extends axially inwardly from an exposed end of the settable member, extends from the outer part into the inner part and subtends at an axis of the settable member an angle which exceeds and contains the angle subtended at said axis by the projection on the outer part.

* * * * *